United States Patent [19]

Mednis

[11] Patent Number: 4,570,799

[45] Date of Patent: Feb. 18, 1986

[54] MULTIPLE CONTAINER PACKAGE

[75] Inventor: Juris M. Mednis, Howell, N.J.

[73] Assignee: Universal Symetrics Corporation, Howell, N.J.

[21] Appl. No.: 577,177

[22] Filed: Feb. 6, 1984

[51] Int. Cl.[4] ..... B65D 21/02

[52] U.S. Cl. ..... 206/509; D9/375; 206/504; 215/10; 220/23.4; 446/124

[58] Field of Search ..... 206/503, 504, 508, 509, 206/162; 220/23.4; 215/10; D9/375; 446/124

[56] References Cited

U.S. PATENT DOCUMENTS

| | | | |
|---|---|---|---|
| D. 73,990 | 11/1927 | Young | D9/375 |
| D. 213,766 | 4/1969 | Weckman | D9/375 |
| D. 247,804 | 5/1978 | Campbell | D9/375 |
| D. 255,039 | 5/1980 | Gale | 446/124 |
| D. 259,766 | 7/1981 | Hartung | D9/375 |
| 3,106,289 | 10/1963 | Chatten | 206/162 |
| 3,334,798 | 8/1967 | Pezely | 446/124 |
| 3,374,917 | 3/1968 | Troy | 220/23.4 |
| 4,106,657 | 8/1978 | Dogliotti | 220/23.4 |

FOREIGN PATENT DOCUMENTS

| | | | |
|---|---|---|---|
| 2304438 | 8/1973 | Fed. Rep. of Germany | 206/508 |
| 2276236 | 1/1976 | France | 220/23.4 |

*Primary Examiner*—George E. Lowrance
*Attorney, Agent, or Firm*—Angelo Notaro

[57] ABSTRACT

A multiple container package includes identical containers, each having an elongated neck and a body portion with a recess which extends in a substantially transverse direction relative to the neck. The neck of each container is received with the recess of the body portion of another container.

21 Claims, 7 Drawing Figures

FIG. 6
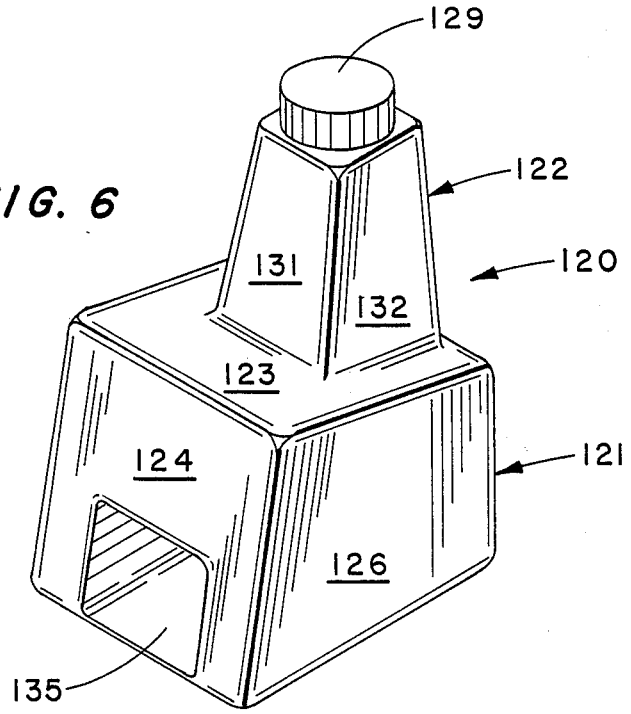
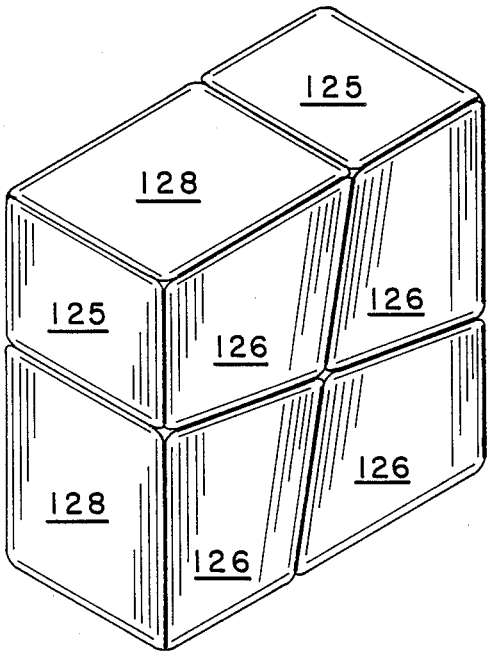
FIG. 7

MULTIPLE CONTAINER PACKAGE

BACKGROUND OF THE INVENTION

This invention relates to containers and, more particularly, to containers which can be interfitted to each other to form a compact, readily-handled multiple container package.

There are many container applications which require the use of a significant neck or spout, extended from a main body portion, to facilitate a directed discharge of the contents of the container. Even where an elongated neck is not essential, containers are often designed with a long neck due to aesthetic considerations or the functional versatility which is achieved. When such containers are packed in a standard rectangular or square carton, a signification volume of the carton comprises wasted dead space, that is, space around the neck which is not occupied by the container. The wasted space must often be filled with packing material to minimize the possibility of damage when the containers are shipped. The lack of utilization of the dead space and the need for additional packing material increase the ultimate point of sale price of the container and the contained material.

Multiple container packaging has been utilized in product areas to facilitate the handling of multiple container units. For example, so-called handy four or six packs are quite popular in consumer beverage markets. Typically, an easily tearable cardboard or a plastic carrying frame or a wrap is employed to hold a multiple number of identical containers in a particular configuration. Handles or finger gripping holes are often incorporated into the frame to allow a consumer to readily carry the combination. In such case, part of the purchase price of the product represents the cost of the cardboard or plastic frame. The balance and distribution of the containers within the frame, moreover, is readily upset by the removal of one or more containers particularly where the container includes an elongated neck.

Arrangements have also been disclosed in which the containers themselves are interengaged into multiple groups. U.S. Pat. No. 4,165,812, for example, discloses a multi-container package in which four containers are secured to each other by interengaging a projection in the lateral side wall of one container with a recess in an abutting lateral side wall of an adjacent container. Although these containers improve packing economy somewhat, utilization of the dead space surrounding the neck is not improved. U.S. Pat. Nos. 3,374,917 and 3,391,824 disclose interlocking block type containers which are stackable to improve packing economy. While a substantial savings in space is achieved, it is clear that packaging inefficiencies still result in relation to the space surrounding the neck of the upper units if such are stacked in a generally rectangular carton. The projection of the neck of the uppermost unit, moreover, limits the number and type of designs of outerwrap or carriers that can be employed for holding a multiple container package.

SUMMARY OF THE INVENTION

In accordance with the invention, a multiple container package comprises a plurality of containers, each having a substantially elongated neck relative to the main material containing body of the container, and a recessed surface which is formed extending in a generally transverse direction relative to the neck. The body is provided with front, rear, and side walls, a bottom wall and a shoulder forming at least a part of the top of the body. The recessed surface is formed in the bottom wall of the body and has an open and at the front wall. The containers are interengaged such that the neck of each is received into the recess of another with the shoulder of each abutting against the front wall of another. A polyhedral-shaped package is formed when four containers are mated. In the preferred embodiments, the rear wall, side walls and bottom wall are planar. In the illustrated embodiments, the front wall and shoulder are also planar. Non-planar surface variants of front wall and shoulder may be adopted.

The various features of novelty which characterize the invention are pointed out with particularity in the claims annexed to and forming a part of this specification. For a better understanding of the invention, its operating advantages and the specific objects attained by its use, reference should be had to the accompanying drawings and descriptive manner in which preferred embodiments of the invention are illustrated.

BRIEF DESCRIPION OF THE DRAWINGS

In the accompanying drawings, forming a part of this specification, and in which reference numerals shown in the drawings designate like or corresponding parts throughout the same, FIG. 1 is a perspective view of a container of a form made in accordance with a first embodiment of the invention;

FIG. 6 is a perspective view of a container of a form made in accordance with a second embodiment of the invention; and FIG. 7 is a side perspective view of a multiple container package of four of the containers of FIG. 6 interengaged in accordance with the teachings of the invention.

DETAILED DESCRIPTION

Figure 1:
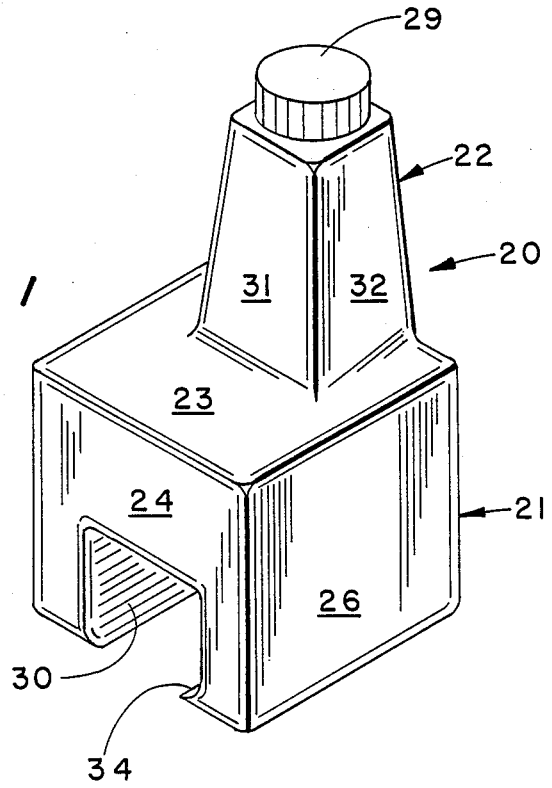
Figure 2:
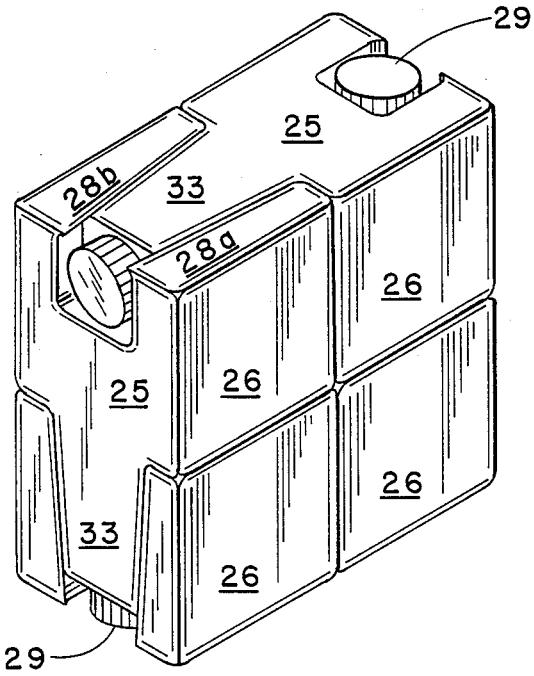
FIG. 2 is a side perspective view of a multiple container package of four of the containers of FIG. 1 which have been interengaged according to the invention.
Figure 3:
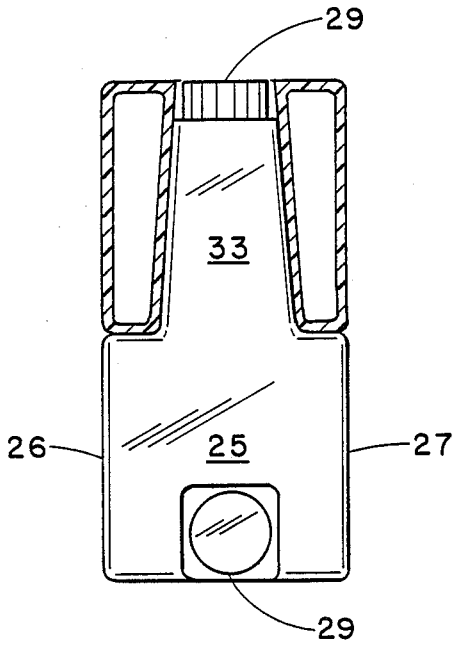
FIG. 3 is a top view, partly in section, of the multiple container package of FIG. 2.

Referring now to the drawing in detail, FIG. 1 shows a container 20. Four containers 20 are serially interengaged through a rectangular path to form a multiple container package as illustrated in FIG. 2.

Each container 20 as best shown in FIGS. 1 to 4 includes a body 21, designed to contain the main volume of the contents of the container, and an elongated neck 22.

The body 21 has an upper shoulder 23 atop a vertical wall portion composed of four polygonal walls —a front wall 24, rear wall 25, and side walls 26, 27 —and is closed at its bottom end by a bottom wall 28. The bottom wall 28 includes an elongated recessed surface 30 bordering a recess, which is open-ended at front wall 24, and outer facial portions **28*a* and 28*b* on each side of the recessed surface. The recess may be closed-ended at its end opposite the front wall or, as shown in FIG. 2, open-ended at the rear wall 25. The recessed surface should have a length at least as long as the neck plus a cap closure 29**.

The neck 22 is integrally formed as part of the container 20. The base of the neck 22 is integral to the shoulder 23 and the rear wall 25 of the body 21. The neck 22 is a hollow, open-ended tube that has a through passage in direct communication with the main chamber housed by the body 21 to allow the ready through passage of the contents of the body. The open end of the neck 22 opposite the body is closed with a cap closure 29 which sealably engages the neck, for example, by engaging threads (not shown) formed around the periphery of the neck 22 adjacent to the end thereof. Other known closure arrangements such as snap-off or snap-on connections or foil seals may be used alone, or in combination, to close the open end of the neck.

The neck 22 has front face 31 and lateral faces 32 which are preferably designed to be closely and contiguously received against the recessed surface 30 of a second, identical container 20, when the neck 22 of a first container 20 is inserted into the recess bordered by the recessed surface 30 as described hereinafter. The neck includes a rear face 33 which lies within the same plane as the face of the rear wall 25 and hence is conplanar therewith. However, the neck including the rear surface could be designed so as to curve away from the plane of the face of rear wall 25.

The neck 22, as shown, has a longitudinally tapering, trapezoidal cross-section with the front face 31 of the neck being wider than the rear face 33. The recessed surface 30 has a complimentary, trapezoidal cross-section. Accordingly, the neck of each container 20, upon axial insertion into the recess of another container 20, is restrained from transverse movement relative to the longitudinal axis of the recessed surface. Lateral interlocking can be enhanced or effecuated by the provision of lips 34 at the edges of the outer facial portions **28*a*, 28*b* which overlie the recess and the rear face 33 of the neck. Other cross-sections can be employed with the same effect. For example, the front face and lateral faces of the neck can be circular, the rear face being provided with an elongated protrusion centered upon and extending over the length of the rear face intermediate identical rear face portions. In such case, the recessed surface would have a complimentary circular surface conforming to the curvature of the front and side faces of the neck 22. The bottom wall 28 of the container would be, adjacent to the opening of the recess in the face of the bottom wall 28**, arranged to overlie a portion of the recess so that the identical portions of the neck within the recess would be set directly under a portion of the bottom wall surface. Although a laterally restrained arrangement is preferred, it is not critical and the neck and recessed surface can be configured to permit the neck to be layed into the recess, that is, moved transversely into the recess relative to its length. The neck can also have a uniform, untapered cross-section over its length.

The neck 22 extends in a transverse direction relative to the recessed surface 30, that is, along an axis which is disposed at substantially ninety-degree angle relative to the lengthwise axis of recessed surface 30. Generally, the neck 22 is centrally located midway between the side walls 26, 27 and the recess is aligned with the neck. The neck 22, including the cap closure 29, preferably has a length substantially equal to the length of the bottom wall, i.e., the distance between the front wall 24 and the rear wall 25 of the body.

In the illustrated preferred embodiment of FIGS. 1–4, the body 21 has the basic shape of a cube. Although the dimensions of the shoulder 23 and the mating front wall 24 should be the same, the shoulder 23 and front wall 24 need not be planar or disposed at right angles relative to each other and, thus, the body 21 need not be cubular. For example, as shown in the embodiment of FIGS. 6 and 7, the shoulder 123 could slope, at an angle relative to the horizontal plane of the bottom wall, downwardly from the front wall 124 to the rear wall 125 with the front wall 124 sloping outwardly (away from the rear wall 125) from the shoulder down to the bottom wall 128. Conversely, in an alternative embodiment (not shown), the shoulder could slope upwardly from the front wall to the rear wall and, in such case, the front wall would slope inwardly, relative to the rear wall, from the shoulder to the bottom wall. In each foregoing embodiments, there would be an angle between the shoulder and front wall of ninety degrees.

In still other embodiments, the shoulder could be formed, for example, with a convex shape which would be contiguously received in a complimentary front wall which would be convex. Such an arrangement creates an interesting single container appearance which increases cohesion between the containers when they are mated to form a package, although the angle between the shoulder and front wall might not be ninety degrees. In all cases, when four of the containers are mated a polyhedron is formed.

In the embodiment of FIGS. 6 and 7, the body 120 itself includes the recess 135. The recess 135 is open at the front wall 124 and extends through the body 121 but, as shown in FIG. 7, is not open at the rear wall 125. The recess 135 is not open to the outside of the body at the bottom wall 128, but is closed by a part of the bottom wall in the form of a thin membrane which overlies the recess. The recess has a sufficient cross-section to slidably receive the neck. The arrangement of FIG. 7, provides a particularly tamper resistant multiple package unit by preventing ready access to the neck 122, including the cap 129, which is received and shielded within the enclosed recess 135.

Figure 4:
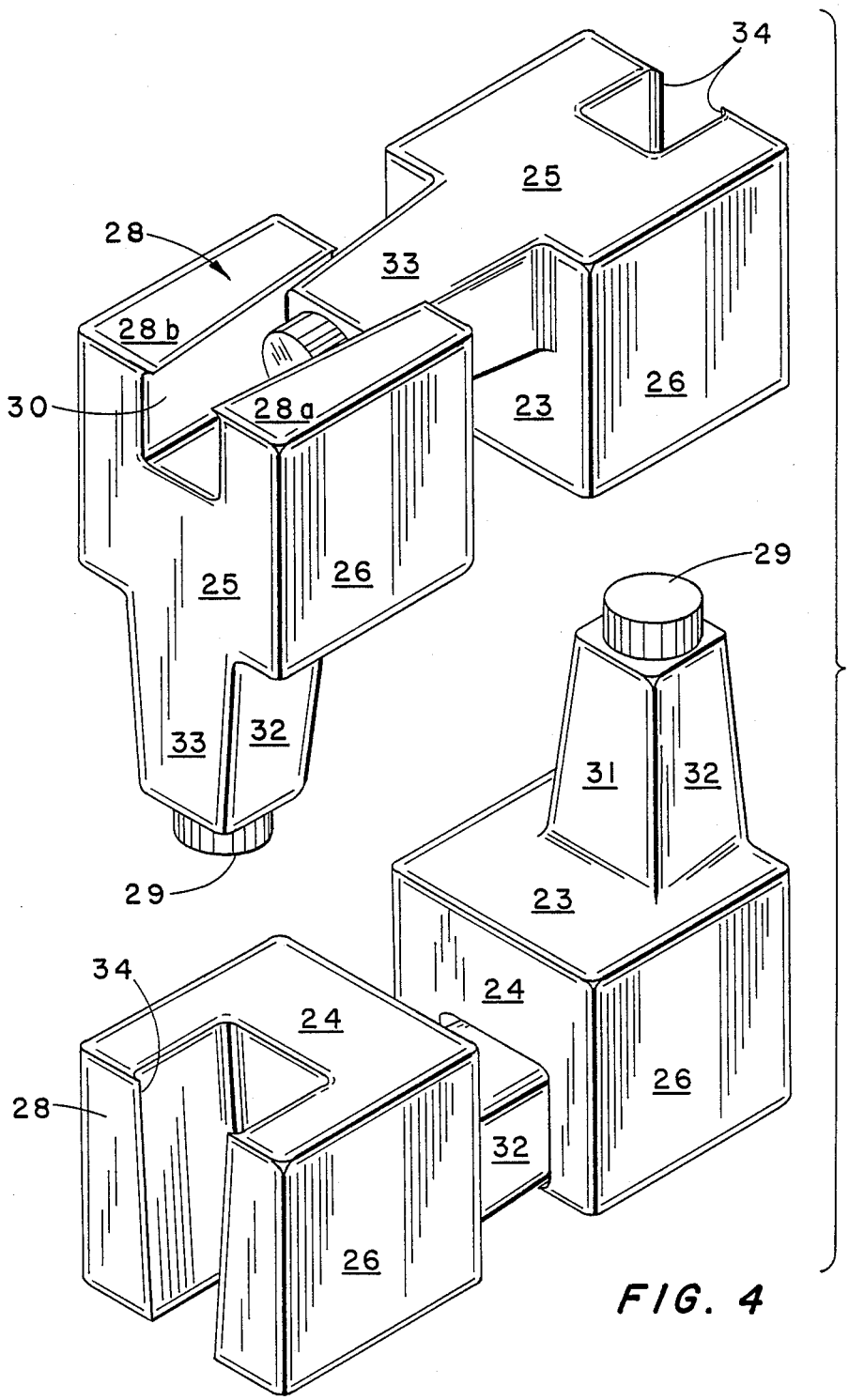
FIG. 4 is an exploded view of the multiple container package of FIG. 2.

Referring to FIGS. 2 and 4, it can be readily seen that a multiple container package is formed by inserting the free end of a neck 22 of a first container through the open end of the recessed surface 30 at the front wall 24 of a second, identical container and sliding the neck into the recess by moving the containers relative to each other until the shoulder 23 of the first container abuts against the front wall 24 of the second container. The neck 22 of the third container is similarly inserted into the recess of a fourth, identical container. The protruding necks 22 of the two sets of paired containers are then, upon rotation of one of the sets, inserted into the remaining open recesses of the recessed surfaces of each other. As a result, four containers are serially interengaged through a substantially rectangular path, with the neck 22 of each being closely received and housed within the recess of the recessed surface 29 of another identical container. In the preferred embodiments of the invention, the recessed surface 30 has a depth which is equal to the distance from the front face 31 to the rear face 33 of the neck 22 and its closure. Hence, the rear face 33 of the neck 22 of a container is substantially flush and aligned with outer facial portions **28*a* and 28*b* of the bottom wall 28 at each side of the opening of the recess to form a substantially continuous polygonal surface which comprises rear face 33 of the neck and rear wall 25 of the one container and the bottom wall 28 of another container. When the four containers are interengaged, as shown in FIG. 2**, the multiple container package assumes the shape of a polyhedron.

The polyhedron shown in FIG. 2 is substantially filled by the four mated containers. It is noted that the polyhedron represents the minimum rectangular polyhedral volume needed to encompass the neck and body of any two of the four containers as mated. Opposite sides or faces of the polyhedron are parallel. Thus the lateral sides 26, 27 of four mated containers as well as the bottom and rear wall of mated containers lie in common planes.

Figure 5:
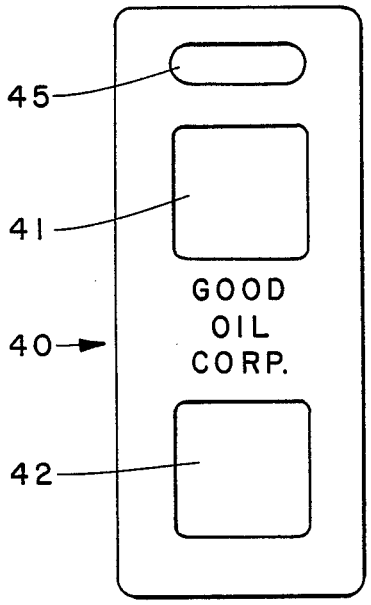
FIG. 5 is an elevation view of a handle which can be interengaged to within the multiple container package of FIG. 2.

Due to its basic geometric shape, a multiple container package may be readily and economically handled and packaged. Shrink wrap plastic film can, for example, be wrapped over the outer surfaces of a four container package. The film could be transparent so that the graphics directly printed on the container are evident or the film itself can be imprinted, or both. A planar handle 40, as shown in FIG. 5, could be interfitted between the containers to provide a simple, inexpensive carrying grip. The handle 40 shown in FIG. 5, is made of a planar material provided with two apertures 41, 42 through which the necks 22 of two of the containers pass. The edges of the apertures engage about the necks. A third aperture 45 is provided as a hand grip. The handle, except for the hand grip, would essentially be mounted between a shoulder and the abutting front wall of two mated containers. The handle could also be formed with two openings, with one being used for passage of a neck and the other being used as a hand grip.

The container, according to the invention, can be readily manufactured using existing plastics technology, processing and manufacturing techniques. The container can also be formed from other materials such as foils or glass. The container is preferably molded or shaped from a thermoplastic such as polyethylene, polyethylene terethalate, polyprophylene, polyvinyl chloride, or the like and produced by process such as injection blow molding, extrusion blow molding, stretch blow molding, extrusion stretch blow molding, or monolayer or multi-layer techniques.

The multiple container package of the invention significantly improves packing economy within standard rectangular cartons by eliminating the dead space which normally exists around the neck. A four unit package is provided which may be conveniently gripped and handled by a user. Moreover, since the neck is housed within the recess and, preferably restrained from lateral movement, the possibility of transit damage and loss is minimized. Since the neck, including its closure, is housed within the recess, the overall package becomes more readily protectible against tampering. Containers mated in accordance with the invention do not need to be fitted with a plastic or cardboard carrying frame.

It will be evident to those skilled in the art that changes may be made to the containers without departing from the spirit of the invention disclosed herein or within the scope of the claims. Thus, the shoulder and the front wall, for instance, can comprise complimentary arcuate surfaces. For example, the shoulder can be formed with a concave surface and the front wall can be formed with a complimentary convex surface designed to be contiguously received against the shoulder of an identical container when the neck of one is inserted into the recess of the other. Such a container would be aesthetically pleasing and allow mating, as described hereinbefore, to form a multiple container package. The continguous abutting of the arcuate shoulder and front wall of identical containers will result in a package which has an extra level of stability.

The embodiments of the invention in which an exclusive property or privilege is claimed are defined as follows:

1. A multiple container package comprising: a plurality of mated containers which together form and substantially fill the volume of a polyhedron having opposite sides in parallel planes; each container having a hollow body which includes a front wall, a planar polygonal rear wall, a planar polygonal bottom wall, planar polygonal lateral side walls and a top shoulder wall, each container having an elongated recess in said bottom wall, said recess extending from the rear wall to the front wall with a length substantially equal to a width of said body between the rear and front walls; each container having an elongated neck extending from the shoulder wall near the rear wall, at least a portion of the neck being coplanar with said planar rear wall, said elongated neck having a length which is substantially equal to the length of the recess; said plurality of containers being mated with the neck of one container extending in the recess of one other container and the shoulder wall of the one container being contiguous with front wall of the one other container, one lateral side wall of each container lying in one of the parallel planes and the other lateral side wall of each container lying in an opposite one of the parallel planes.

2. A multiple container package as recited in claim 1 wherein the bottom wall includes a recessed surface bordering the recess and wherein the recess is open to the outside of the body along its length.

3. A multiple container package as recited in claim 2 wherein the neck has a trapezoidal cross section and the recessed surface has a cross section complimentary to the cross section of the neck so that the recessed surface is contiguous to the surface of a neck received within the recess.

4. A multiple container package as recited in claim 3 wherein the neck tapers as the distance of the neck from the body increases.

5. A multiple container package as recited in claim 3 wherein the neck has a front face and a rear face, the front face having width which is wider than the width of the rear face.

6. A multiple container package as recited in claim 5 wherein the recessed surface has a depth which is equal to the distance from the front face to the rear face of the neck.

7. A multiple container package as recited in claim 5 wherein the rear face of the neck of each container is flush with the face of the bottom wall of the container having the recess in which the neck is received.

8. A multiple container package as recited in claim 7 wherein the recessed surface has a depth which is equal to the distance from the front face to the rear face of the neck.

9. A multiple container package as recited in claim 1 wherein the containers are serially interengaged through a substantially rectangular path.

10. A multiple container package as recited in claim 9 comprising four containers.

11. A multiple container package as recited in claim 1 comprising four containers.

12. A multiple container package as recited in claim 2 comprising four containers.

13. A multiple container package as recited in claim 2 wherein the neck has a uniform, untapered cross-section over its length.

14. A multiple container package as recited in claim 1 wherein the shoulder extends from the front wall to the rear wall at an angle related to the plane of the bottom wall and the front wall extends from the shoulder to the bottom wall at an angle relative to the plane of the rear wall.

15. A multiple container package as recited in claim 14 wherein the shoulder slopes downwardly from the front wall to the rear wall and the front wall slopes outwardly, relative to the rear wall, from the shoulder to the bottom wall.

16. A multiple container package as recited in claim 15 wherein further comprising an angle between the front wall and the shoulder of ninety degrees.

17. A multiple container package as recited in claim 1 further comprising means for carrying the interengaged containers including a support, intermediate a shoulder and abutting front wall, engaging about at least one neck.

18. A multiple container package as recited in claim 1 wherein said front wall and bottom wall of said hollow body are both planar and polygonal, all of said polygonal walls of said hollow body comprising rectangles.

19. A multiple container package as recited in claim 18 wherein said polyhedron which is substantially filled by said mated containers comprises the minimum rectangular polyhedral volume needed to encompass the neck and body of two of said plurality of containers.

20. A multiple container package as recited in claim 19 wherein said elongated recess is open at said front and rear walls and is open at a side thereof in said bottom wall.

21. A multiple container package as recited in claim 1 wherein each container has an elongated recess only in said bottom wall.

* * * * *